US005526031A

United States Patent [19]

Kurabayashi

[11] Patent Number: 5,526,031

[45] Date of Patent: Jun. 11, 1996

[54] RECORDING MEDIUM, INK-JET RECORDING METHOD USING THE SAME, AND INK-JET RECORDED ARTICLE

[75] Inventor: Yutaka Kurabayashi, Tokorozawa, Japan

[73] Assignee: Canon Kabushiki Kaisha, Tokyo, Japan

[21] Appl. No.: 196,507

[22] Filed: Feb. 15, 1994

[30] Foreign Application Priority Data

Feb. 16, 1993 [JP] Japan ..... 5-026931

[51] Int. Cl.[6] ..... B41J 2/005; B41M 5/00

[52] U.S. Cl. ..... 347/105; 428/480; 428/483; 428/500

[58] Field of Search ..... 347/105; 428/480, 428/483, 500; 283/117

[56] References Cited

U.S. PATENT DOCUMENTS

| | | | |
|---|---|---|---|
| 4,547,405 | 10/1985 | Bedell et al. | 428/256 |
| 4,956,230 | 12/1990 | Edwards et al. | 428/341 |
| 5,081,470 | 1/1992 | Kurabayashi et al. | 346/1.1 |
| 5,124,201 | 6/1992 | Kurabayashi et al. | 428/323 |
| 5,137,778 | 8/1992 | Nakatsugawa et al. | 428/330 |
| 5,171,626 | 12/1992 | Nagamine et al. | 428/212 |
| 5,246,774 | 9/1993 | Sakaki et al. | 428/323 |
| 5,277,962 | 1/1994 | Nakatsugawa et al. | 428/206 |

FOREIGN PATENT DOCUMENTS

| | | |
|---|---|---|
| 0490545A2 | 6/1992 | European Pat. Off. . |
| 02270588 | 4/1989 | Japan . |
| 04179967 | 11/1990 | Japan . |
| WO91-13207 | 9/1991 | WIPO . |

*Primary Examiner*—Benjamin R. Fuller
*Assistant Examiner*—Valerie Ann Lund
*Attorney, Agent, or Firm*—Fitzpatrick, Cella, Harper & Scinto

[57] ABSTRACT

Disclosed herein is a recording medium comprising at least a base and an ink-receiving layer of either a water soluble or hydrophilic polymer and wherein said base comprises a biodegradable polymeric material. The biodegradable polymer is a copolymer of 3-hydroxybutyrate and 4-hydroxybutyrate. The recording medium has good ink-jet recordability owing to the formation of a suitable ink-receiving layer.

22 Claims, 3 Drawing Sheets

RECORDING MEDIUM, INK-JET RECORDING METHOD USING THE SAME, AND INK-JET RECORDED ARTICLE

BACKGROUND OF THE INVENTION

1. Field of the Invention

The present invention relates to a recording medium, particularly to a recording medium suitable for use in ink-jet recording, an ink-jet recording method using the same, and an ink-jet recorded article.

2. Related Background Art

An ink-jet recording method attracts attention as a printing method which scarcely produces noise and can conduct high-speed printing and color printing.

As recording media used in this ink-jet recording method, there have been used, for example, paper for ink-jet recording in which a specific porous ink-receiving layer is provided on a base essentially consisting of ordinary plain paper, and transparent recording media for overhead projection (OHP) in which the same ink-receiving layer as that used in the paper for ink-jet recording is provided on a sheet essentially consisting of a synthetic plastic.

Particularly speaking on the recording media for OHP, as materials making up these media, mainly materials making up bases, there have been used films comprising a synthetic plastic such as a polyester resin, diacetate resin, triacetate resin, acrylic resin, polycarbonate resin, polyvinyl chloride resin or polyimide resin.

On the other hand, the amounts of synthetic plastic materials used in a variety of industrial fields show a tendency to increase year by year. The amount of waste synthetic plastics also increases correspondingly, and so their disposal becomes a great social problem in the world. These waste plastics are recovered to incinerate or subject to disposal by land-fills.

The incineration of the conventional synthetic plastics have often caused damage to an incinerator because of their high calorific value. In addition, many of them have generated harmful gases upon their incineration. Besides, in the disposal by land-fills, problems of maintaining places of the disposal and of adversely affecting natural environment also have come to be considerable.

Under such circumstances, the problem of waste disposal after use also has become important on articles of consumption for ink-jet recording making use of synthetic plastics with the spread thereof from the viewpoint of environmental problem or the like.

In particular, the recording media for OHP must claim adequate consideration for the waste disposal after use because their bases are made up of a synthetic plastic as described above. The conventional OHP films for ink-jet take no account of the problems of the waste disposal as described above, and so they have some fear of adverse influence on environment when they are discarded in plenty.

SUMMARY OF THE INVENTION

It is an object of the present invention to provide a recording medium which is excellent in ink-jet recordability such as, in particular, ink absorptivity and coloring ability, and also in dimensional stability (resistance to curling) and blocking resistance, and permits the most possible suppression of adverse influence on environment when it is discarded.

It is another object of the present invention to provide an ink-jet recording method using the above recording medium.

It is still another object of the present invention to provide an ink-jet recording article obtained by using the above recording medium and ink-jet recording method.

The above objects can be achieved by the present invention described below.

According to the present invention, there is thus provided a recording medium comprising at least a base and an ink-receiving layer, wherein said base comprises a biodegradable polymeric material.

According to the present invention, there is also provided a recording medium comprising a base comprising at least a mixed polyester of 3-hydroxybutyrate and 4-hydroxy-butyrate, and an ink-receiving layer provided on the base.

According to the present invention, there is further provided an ink-jet recording method comprising a step of imparting ink droplets to the recording medium comprising at least a base and an ink-receiving layer, wherein said base comprises a biodegradable polymeric material.

According to the present invention, there is still further provided an ink-jet recorded article obtained by imparting ink droplets to an ink-receiving layer of a recording medium comprising at least a base and the ink-receiving layer, wherein said base comprises a biodegradable polymeric material.

The recording medium according to the present invention comprises a base and an ink-receiving layer, and said base comprises a biodegradable polymeric material, in particular, a biodegradable plastic. Therefore, as described below, the recording medium is given with good ink-jet recordability and moreover possesses biodegradability, which permits the most possible suppression of adverse influence on environment when it is discarded.

DETAILED DESCRIPTION OF THE PREFERRED EMBODIMENTS

Figure 1:
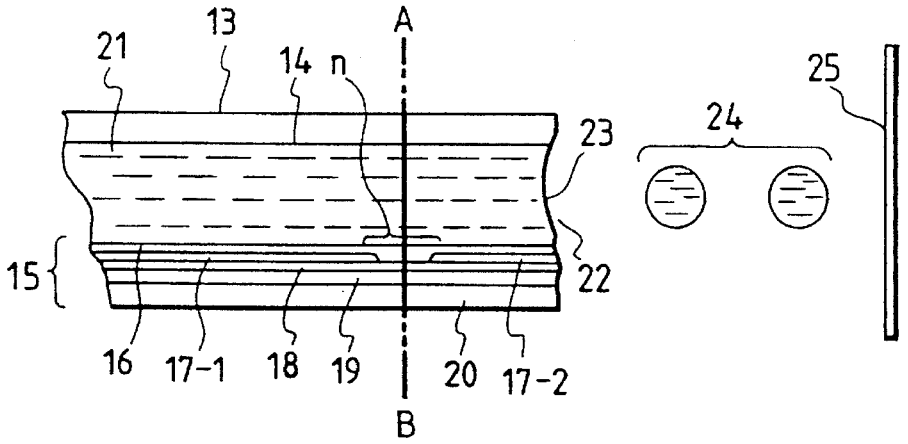
FIG. 1 is a longitudinal cross section of an illustrative head of an ink-jet recording apparatus suitable for use in the present invention.

The present invention will hereinafter be described in detail.

The biodegradable polymeric material useful as a material for the base of the recording medium according to the present invention is a polymeric material which shows good stability as a base of the recording medium without undergoing deterioration or the like under general environmental conditions at the time recording is being conducted on the recording medium, or the medium is being applied to another end, but undergoes cutting of its molecular bond at a higher speed than a control under specific biological environmental conditions. More specifically, polymeric materials applicable to the present invention having such properties are classified roughly into the following three kinds:

1) So-called biodegradable plastics which are formed of a polymer produced by microorganisms, a biodegradable synthetic plastic such as polyester, or a natural polymer such as cellulose, and completely decomposed into $CO_2$ and $H_2O$ by the action of microorganisms.

2) Biodegradable plastics formed by adding a biodegradable substance such as starch to a plastic.

3) So-called photodegradable plastics imparted, in addition to the biodegradability, with photodegradability by ultraviolet rays by adding a certain additive to a biodegradable plastic.

Specific examples of the above-described degradable plastics are mentioned below.

The biodegradable plastics of 1) can be classified into a) a microbial production system, b) a natural polymer system and c) a biodegradable synthetic polymer system from petroleum materials. Specific examples of the respective degradable plastics will hereinafter be described.

a) Microbial Production System

Polymers of the microbial production system include linear polyester of 3-hydroxybutyric acid (3HB) and 3-hydroxyvaleric acid (3HV) (trade name: Biopole, product of ICI, Ltd.). This polymer is produced by sugar fermentation by *Alcaligenes eutrophus,* and the molecule itself is biodegraded. In addition, they include linear polyester of 3-hydroxybutyric acid (3HB) and 4-hydroxybutyric acid (4HB), polyhydroxyalkanoate (PHA, general term for polyester compounds produced by microorganisms), Curdlan (trade name, product of Takeda Chemical Industries, Ltd.) which is a polysaccharide composed of B-1,3-glucan, and the like.

b) Natural Polymer System

Polymers of the natural polymer system include benzylated wood (products obtained by treating cellulose or lignin of wood or the like with an alkali such as caustic soda and reacting the thus-treated product with a chemical material having a benzyl group and an acetyl group to form a plastic), wood esterified with a higher fatty acid, polymers obtained by adding glycerol, glycol, emulsified silicone oil or urea to gluten of wheat, polymers obtained by adding chitosan to cellulose, pullulan, alginic acid, chitin, chitosan, carrageenan, starch, and the like.

c) Biodegradable Synthetic Polymer System From Petroleum Materials

Polymers of the biodegradable synthetic polymer system from petroleum materials include polyester polyether, polyester olefin, ethylene-vinyl alcohol copolymers, polyester amide, nylon (decamer or lower-molecular weight products), polyester, polyether, copolymers of polyurethane and aliphatic polyamide, copolymers of aromatic polyester and aliphatic polyester, polyamide, caprolactone, and the like.

The incorporated type degradable plastics of 2) include mixtures of polycaprolactone (PCL) and polypropylene, mixtures of PCL and nylon-6, mixtures of PCL and polystyrene, mixtures of PCL and polyethylene terephthalate, mixtures of low-density polyethylene and PCL, mixtures of PCL and hydrated magnesium silicate, and Polyclean (trade name, product of Archer-Daniels-Midland Co.), Polygrade II and III (trade name, products of Ampaset Co.), Ecostar (trade name, product of St. Lawrence Starch Co.) and Tone (trade name, product of Union Carbide Corp.), which are obtained by mixing corn starch or another starch with a synthetic plastic such as polyethylene or polypropylene, etc. Incidentally, Ecostar is made up by dispersing starch in polyethylene. It is degraded by a mechanism that the starch dispersed therein is eroded by microorganisms and a mechanism that the molecular chain is cut by a peroxide.

The incorporated type degradable plastics are degraded by assimilating corn starch, another starch or the like dispersed in the plastics by microorganisms to cut their bonds and further cutting their molecular chains by a peroxide. However, they are different from the above-described biodegradable plastics in the progress of the degradation.

The photodegradable plastics of 3) may include ECO (trade name, product of Dow Chemical Co., E. I. du Pont de Nemours and Co., or Union Carbide Corp.) which is a copolymer of ethylene and carbon monoxide, Nucnal P (trade name, Nippon Unicar Co., Ltd.), Polygrade (trade name, product of Ampaset Co.), Plastigon (trade name, product of Idea Masters Co.), Ecolyte (trade name, product of Eco Plastic Co.), polymers obtained by adding Fe(III) acetylacetonate (AcAc) to low-density polyethylene (LDPE), Complexes of dithiocarbamate and AcAc, polymers obtained by adding Zn(II) diethyl carbamate (DEC) and Ni(II) DEC to LDPE, substituted polyacetin composed of a specific polymer containing silicon and a degradation-facilitating agent, polymers obtained by adding xanthone or anthraquinone to polyolefin, polymers obtained by adding oxime methacrylate or a metal complex to an allyl acid ester, oxidized wax added with a metal, Ecostar Plus [trade name, product of St. Lawrence Starch Co., which is given with photodegradability (degraded in accordance with Norrishll reaction) by adding a certain additive to Ecostar as described above], etc.

These biodegradable polymeric materials are not adversely affected during the life-cycle of their use, but degraded for the first time by placing them in an environment such as in the ground or under water, in which microorganism are lively active, or an environment exposed to ultraviolet rays. The process of this degradation is purely biological or photochemical. The biodegradable plastics decomposed by the action of microorganisms are finally degraded into carbon dioxide and water.

Of the biodegradable polymeric materials, the biodegradable plastics from petroleum materials, the incorporated type degradable plastics and the photodegradable plastics are particularly preferred from the viewpoint of processability and dimensional stability.

In the recording media according to the present invention, both transparent bases and opaque bases may be applied as the base.

If the base is opaque, it is possible to incorporate at least one colorant into the recording medium in order to adjust the color tone of the whole recording medium. As such a colorant, may be used the conventionally-known dyes, pigments and the like. The proportion of the colorant to be used may be suitably set depending upon the kinds of materials for the base and colorant. In any event, it is necessary to fully consider the compatibility of the colorant with the base.

The recording medium according to the present invention may be particularly preferably applied to a recording film for OHP where a transparent base is used. When it is used as a transparent recording medium such as a film for OHP, the medium preferably have a haze degree not higher than 50%, more preferably not higher than 20% as a whole. The biodegradable plastic used as a base of the film for OHP may preferably be of the polyester system which is good in transparency and may be formed into a film.

More specifically, as the transparent base, particularly preferred is a co-polyester of 3-hydroxybutyrate (3HB) and 4-hydroxybutyrate (4HB) ["Chemistry", 45 (2), 104 (1990); "Industrial Materials", 38 (1), 33 (1990); "DOJIN News", No. 4 (1989)].

The molar ratio of the components in such a copolymer of 3HB and 4HB may preferably be within a range of from 10 to 40% in terms of the percentage for 3HB, in particular, from the viewpoint of achieving excellent transparency. Besides, the molecular weight of the copolymer may preferably be within a range of from 100,000 to 3,000,000 taking the film forming properties into consideration. Further, in order to improve the transparency and flexibility when used as a base of a recording medium for OHP, it may be permissible to mix the conventionally-known polyvinyl alcohol, high-molecular weight polyethylene glycol (molecular weight: 6,000 or higher), cellulose or the like having biodegradability into the base. The proportion of such a compound to be mixed may vary depending upon the intended end application, but a range of from 1 to 30% by weight based on the polyester is preferred as a standard.

In the recording medium according to the present invention, an ink-receiving layer is provided on the base as described above to form a recording surface. Materials of such an ink-receiving layer must be selected according to the kind of ink to be applied. It is however possible to use such conventionally-known materials as used in a coating layer of, for example, common coated paper without particular problems.

In particular, the recording medium according to the present invention may preferably be used as a recording medium for ink-jet recording by suitably selecting the ink-receiving layer for provision.

Particularly, for recording materials for ink-jet making use of a water-based ink upon recording, specific examples of the material for the ink-receiving layer of such a recording medium include hydrophilic natural materials such as albumin, gelatin, casein, starch, cationic starch, gum arabic and sodium alginate, and water-soluble or hydrophilic synthetic resins such as polyvinyl alcohol, cationic polyvinyl alcohol, polyamide, polyacrylamide, polyvinyl pyrrolidone, quaternized polyvinyl pyrrolidone, poly(N-vinyl-3-methylpyrrolidone), polyvinylimidazole, polyallylamine, polyallylamine hydrochloride, polyethylene imine, polyvinylpyridinium halides, melamine resins, polyurethane, carboxymethyl cellulose, hydroxyethyl cellulose, cationic hydroxyethyl cellulose, hydroxypropyl cellulose, polyester and sodium polyacrylate. One or more layers composed of these materials may be used as desired.

In order to improve ink-jet recordability, specifically, beading resistance and blocking resistance, it is also possible to suitably use water-soluble, low-molecular weight organic compounds and water-insoluble organic compounds in addition to the above-described materials.

The water-soluble, low-molecular weight organic compounds include polyhydric alcohols having a molecular weight not higher than 5,000, typified by ethylene glycol, polyethylene glycol, poly(ethylene glycol-propylene glycol) copolymers, D-sorbitol and sucrose.

The water-insoluble organic compounds include acrylic resins typified by polymethyl methacrylate, nylon resins typified by 6,6-nylon, polystyrene, phenol resins, epoxy resins, polyvinyl chloride, polyester resins, polyurethane resins, and besides, condensates of D-sorbitol and an aromatic aldehyde and diacetate compounds, etc.

In the above-described recording media for ink-jet recording, it is also possible to contain other additives than the components for the ink-receiving layer in the ink-receiving layer with a view toward improving various ink-jet recording properties.

For example, if an acid dye or direct dye is used in a water-based ink to be applied, a cationic resin may be used for preventing the bleeding and dissolving-out of the dye after recording. Examples of materials usable for this purpose include cationic polyvinyl alcohol, cationic hydroxyethyl cellulose, cationic monomer-containing acrylic resins and the like.

In order to improve the blocking resistance, it is also possible to add inorganic fine particles or the like to the ink-receiving layer in a proportion of the order of from 0.01 to 1.0 $g/m^2$.

Similarly, it is also possible to contain the conventionally-known additives such as a pH adjustor, fluorescent dye, dispersant, lubricant, antiseptic and antifoaming agent in the ink-receiving layer.

The thickness of the ink-receiving layer of the recording medium according to the present invention is preferably within a range of from 0.1 to 100 μm, more desirably from 2 to 30 μm. It is also preferable that the materials making up the ink-receiving layer be biodegradable. However, the object of the present invention can be satisfactorily achieved even if all the components are not necessarily biodegradable. The reason is that the ink-receiving layer forms a relatively small proportion of the recording medium according to the present invention judging from the whole weight of the recording medium.

The ink-receiving layer may be formed by means of the conventionally-known method such as a roll coating method, a rod bar coating method, a spray coating method or an air knife coating method.

In the present invention, it may be permissible to mix a polymeric substance such as polyvinyl alcohol or polyethylene glycol with the above-described biodegradable plastic in order to enhance the flexibility of the base. The proportion to be mixed may preferably be within a range of from 5 to 30 parts by weight per 100 parts by weight of the biodegradable plastic. This permits the improvement of, for example, the conveyability of the recording medium in a printer.

Ink-jet recording making use of the recording medium according to the present invention will hereinafter be described with reference to a recording apparatus therefor.

In this invention, it is preferable to apply ink droplets to the ink-receiving layer of the recording medium as described above in accordance with to one of various ink-jet systems. It is particularly preferable to use a system in which droplets are ejected by means of bubbles generated by thermal energy. More specifically, recording signals according to images are applied to a recording ink within a recording head to eject ink droplets by thermal energy generated, and the droplets are applied to the ink-receiving layer of the recording medium.

Examples of the construction of an head, which is a main component of an ink-jet recording apparatus suitable for use in such an ink-jet recording method are described with reference to FIGS. 1 to 3.

Figure 2:
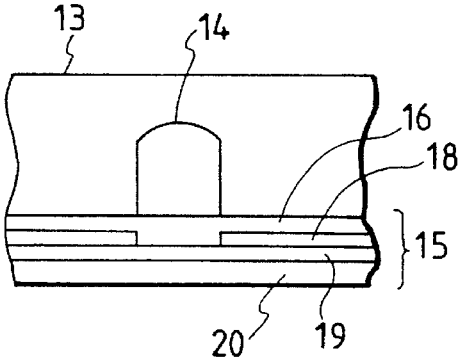
FIG. 2 is a transverse cross section of the head of the ink-jet recording apparatus suitable for use in the present invention.

FIG. 1 is a cross-sectional view of a recording head 13 taken along the flow path of an ink, and FIG. 2 is a cross-sectional view taken along line A–B in FIG. 1.

In FIGS. 1 and 2, the head 13 is formed by bonding a glass, ceramic or plastic plate or the like having a groove through which an ink is passed, to a heating head 15, which is used for thermal recording and has a heating resistor (the drawing shows a head to which, however, is not limited). The heating head 15 is composed of a protective film 16 made of silicon oxide or the like, aluminum electrodes 17-1 and 17-2, a heating resistor layer 18 made of nichrome or the like, a heat accumulating layer 19, and a substrate 20 made of alumina or the like having a good heat radiating property.

A recording ink 21 comes up to an ejection orifice 22 and forms a meniscus 23 owing to a pressure P.

Now, upon application of electric signals to the electrodes 17-1, 17-2, the heating head 15 rapidly generates heat at the region shown by n to form bubbles in the ink 21 which is in contact with this region. The meniscus 23 of the ink is projected by the action of the pressure thus produced, and the ink 21 is ejected from the orifice 22 to a recording material 25 in the form of recording droplets 24.

Figure 3:
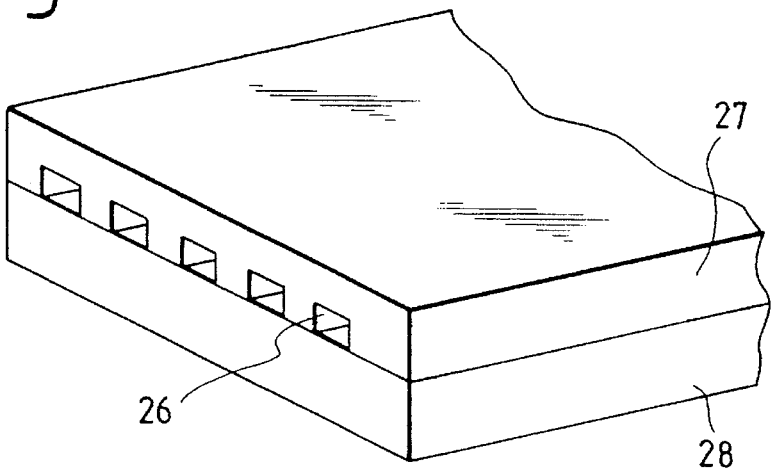
FIG. 3 is a perspective view of the appearance of another illustrative head of the ink-jet recording apparatus suitable for use in the present invention.

FIG. 3 schematically illustrates a multi-head composed of an array of a number of heads as shown in FIG. 1. The multi-head is formed by closely bonding a glass plate or the like 27 having a number of channels to a heating head 28 similar to the head as illustrated in FIG. 1.

Figure 4:
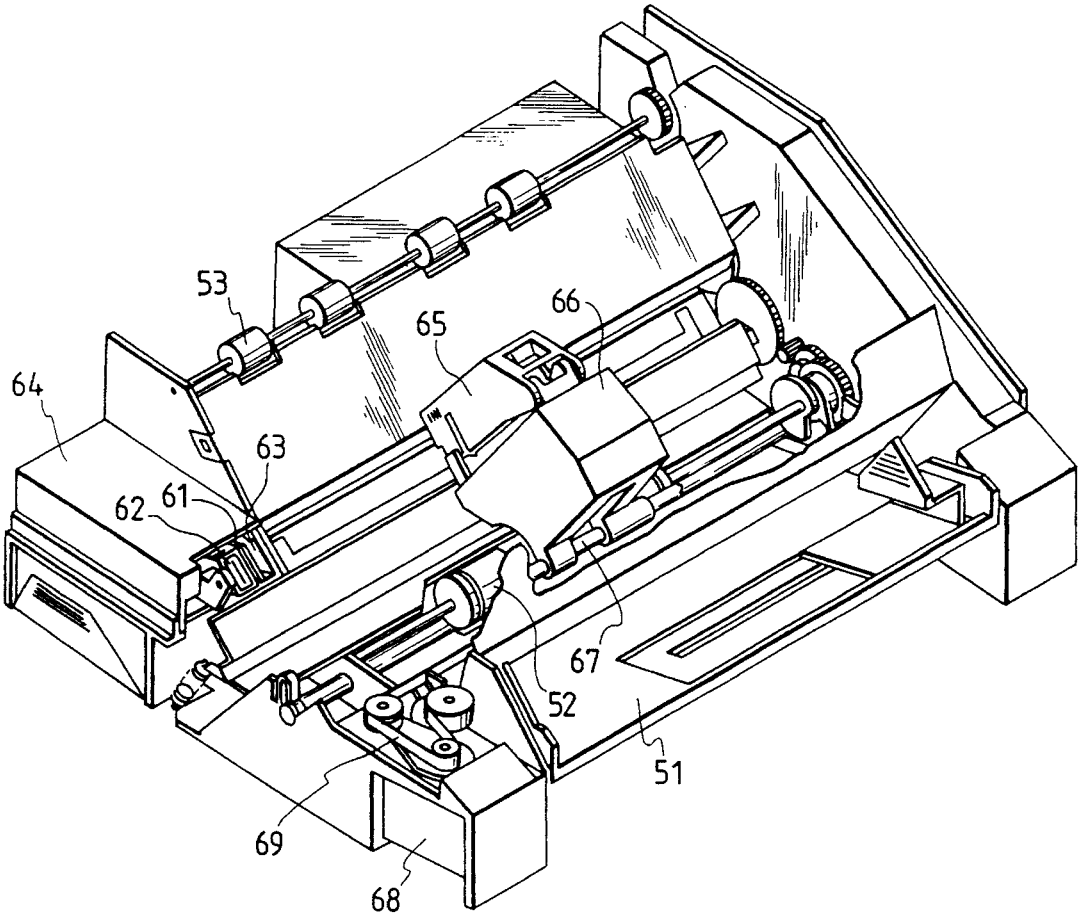
FIG. 4 is a perspective view of an illustrative ink-jet recording apparatus suitable for use in the present invention.

FIG. 4 illustrates an example of an ink-jet recording apparatus in which such a head has been incorporated.

In FIG. 4, reference numeral 61 designates a blade serving as a wiping member, one end of which is a stationary end held by a blade-holding member to form a cantilever. The blade 61 is provided at the position adjacent to the region in which a recording head makes a record, and is so constituted that it moves in the direction perpendicular to the direction in which the recording head is moved and comes into contact with the face of ejection openings to cap it. Reference numeral 63 denotes an ink-absorbing member provided adjoiningly to the blade 61 and, similar to the blade 61, held in such a form that it protrudes to the course through which the recording head is moved. The above-described blade 61, cap 62 and absorbing member 63 constitute an ejection-recovery portion 64, where the blade 61 and absorbing member 63 remove off water, dust and/or the like from the face of the ink-ejecting openings.

Reference numeral 65 designates the recording head having an ejection-energy-generating means and serving to eject the ink onto a recording material set in an opposing relation with the ejection opening face provided with ejection openings to conduct recording. Reference numeral 66 indicates a carriage on which the recording head 65 is mounted so that the recording head 65 can be moved. The carriage 66 is slidably interlocked with a guide rod 67 and is connected (not illustrated) at its part to a belt 69 driven by a motor 68. Thus, the carriage 66 can be moved along the guide rod 67 and hence, the recording head 65 can be moved from a recording region to a region adjacent thereto.

Reference numerals 51 and 52 denote a paper feeding part from which the recording materials are separately inserted, and paper feed rollers driven by a motor (not illustrated), respectively. With such construction, the recording material is fed to the position opposite to the ejection opening face of the recording head, and discharged from a paper discharge section provided with paper discharge rollers 53 with the progress of recording.

In the above constitution, the cap 62 in the head recovery portion 64 is receded from the moving course of the recording head 65 when the recording head 65 is returned to its home position, for example, after completion of recording, and the blade 61 remains protruded to the moving course. As a result, the ejection opening face of the recording head 65 is wiped. When the cap 62 comes into contact with the ejection opening face of the recording head 65 to cap it, the cap 62 is moved so as to protrude to the moving course of the recording head.

When the recording head 65 is moved from its home position to the position at which recording is started, the cap 62 and the blade 61 are at the same positions as the positions upon the wiping as described above. As a result, the ejection opening face of the recording head 65 is also wiped at the time of this movement.

The above movement of the recording head to its home position is made not only when the recording is completed or the recording head is recovered for ejection, but also when the recording head is moved between recording regions for the purpose of recording, during which it is moved to the home position adjacent to each recording region at given intervals, where the ejection opening face is wiped in accordance with this movement.

Other components of the recording apparatus used in the present invention are then described with reference to FIGS. 5 and 6.

Figure 5:
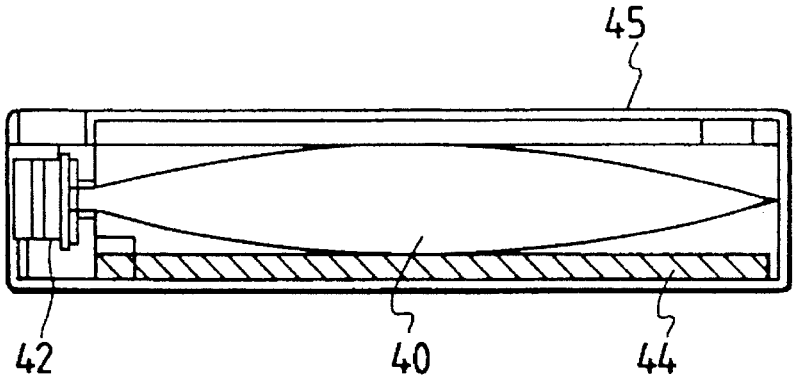
FIG. 5 is a longitudinal cross section of an illustrative ink cartridge of the ink-jet recording apparatus suitable for use in the present invention.

FIG. 5 illustrates an exemplary ink cartridge in which an ink fed to the head through an ink-feeding member, for example, a tube is contained. Here, reference numeral 40 designates an ink container portion containing the ink to be fed, as exemplified by a bag for the ink. One end thereof is provided with a stopper 42 made of rubber. A needle (not illustrated) may be inserted into this stopper 42 so that the ink in the bag 40 for the ink can be fed to the head. Reference numeral 44 indicates an ink absorbing member for receiving a waste ink.

It is preferred that the ink container portion be formed of a polyolefin, in particular, polyethylene, at its surface with which the ink comes into contact.

The ink-jet recording apparatus used in the present invention may not be limited to the apparatus as described above in which the head and the ink cartridge are separately provided. Therefore, the following recording unit in which these members are integrally formed as shown in FIG. 6 can also be preferably used.

Figure 6:
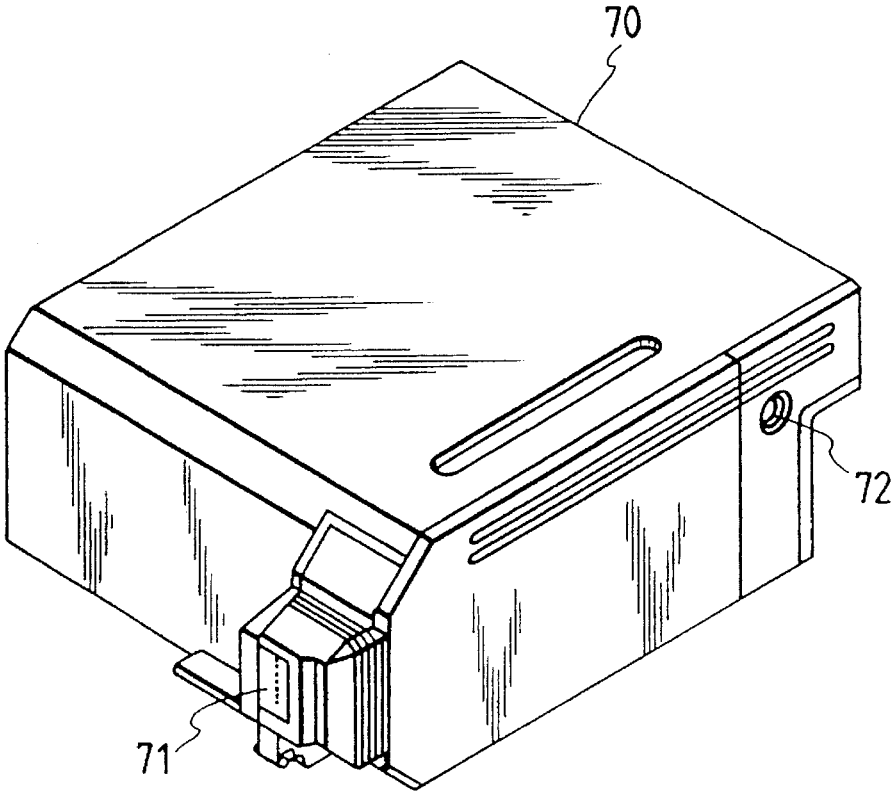
FIG. 6 is a perspective view of an illustrative recording unit of the ink-jet recording apparatus suitable for use in the present invention.

In a recording unit 70 illustrated in FIG. 6, an ink container portion containing an ink, for example, an ink-absorbing member, is contained in the interior thereof. The recording unit 70 is so constructed that the ink in such an ink-absorbing member is ejected in the form of ink droplets through a head 71 having a plurality of orifices. For example, polyurethane may be used as a material for the ink-absorbing member. Reference numeral 72 indicates an air passage for communicating the interior of the recording unit 70 with the atmosphere. This recording unit 70 can be used in place of the recording head shown in FIG. 3, and is detachably installed on the carriage 66. Incidentally, in the recording apparatus used in the present invention, the ink-jet recording apparatus in which heat energy is caused to act on an ink to eject out droplets of the ink has been described by way of example. However, the present invention can also be applied to another ink-jet recording apparatus of a piezo-system making use of a piezoelectric element.

The present invention will hereinafter be described in more detail by Examples.

Example 1

A base obtained by forming a biodegradable plastic, "Curdian" (trade name, product of Takeda Chemical Industries, Ltd.) into a sheet to give a thickness of 300 μm was coated with a coating formulation of a composition shown in the following Table 1 by a bar coater method to give a dry coat weight of 20 g/m$^2$. The base thus coated was dried at 110° C. for 5 minutes to obtain a recording medium of Example 1.

TABLE 1

| Component of coating formulation | Content (parts by weight) |
|---|---|
| Polyvinyl pyrrolidone*[1] | 90 |
| Cation-modified polyvinyl alcohol*[2] | 10 |
| Water | 600 |

Note:
*[1]"K-90" (trade name, product of GAF Corp., molecular weight: not less than 100,000).
*[2]"PVA-C318-2A" (trade name, product of Kuraray Co., Ltd., saponification degree: 89%, polymerization degree: 1,800).

On the recording medium, was effected ink-jet recording with four inks of a composition shown in Table 2, which respectively contained the following dyes, using a recording apparatus having 4 ink-jet recording heads (360 dpi, maximum recording density of a single color: 8 nl/mm$^2$, ejecting frequency: 5.6 kHz) in which an ink is ejected by bubbling of the ink.

Black dye: C.I. Food Black 2

Yellow dye: C.I. Direct Yellow 86

Magenta dye: C.I. Acid Red 289

Cyan dye: C.I. Acid Blue 9.

TABLE 2

| Component of ink composition | Content (% by weight) |
|---|---|
| Dye | 3.0 |
| Diethylene glycol | 15.0 |
| Water | 82.0 |

With respect to the resulting print sample, the following properties (1) to (3) as ink-jet recordability were evaluated. Besides, the biodegradability described in (4) was also evaluated (1) Ink Absorptivity The ink absorptivity of the recording medium when solid prints of secondary colors, R, G and B (16 nl/mm$^2$) were separately conducted by means of the above ink-jet recording apparatus was evaluated by comparing its fixability with that of a commercially-available OHP film for color ink-jet (CG-3480, product of Sumitomo 3M Limited) to rank it as A where the fixability was equal to or better than the commercially-available film.

(2) Resolution

The resolution of the recording medium when a full-color image was printed was visually evaluated in comparison with an image printed on a coated paper sheet for ink-jet in a similar manner to rank it as A where the resolution was equal to or better than the coated paper sheet.

(3) Resistance to Curling

A solid print of a secondary color (16 nl/mm$^2$) was conducted throughout the recording medium having a size of A4 to visually evaluate its resistance to curling, which was ranked as A where curling occurred at this time was on a level practicable without problems.

(4) Biodegradability

Upon elapsed time of 6 months after discarding the recording medium in the ground, it was taken out of the ground to observe whether the biodegradation of the medium progressed or not. The biodegradability was ranked as A where the biodegradation was recognized.

The results of the evaluation are shown in Table 5. In the evaluation results, all the ranks of the items (1) to (4) were A.

Examples 2 to 4

In each example, a biodegradable plastic having a thickness of 100 μm was used as a base.

Materials used in the Examples are given collectively in the following Table 3.

TABLE 3

| Example | Biodegradable plastic used as base |
|---|---|
| 2 | "Bionolle" (product of Showa Highpolymer Co., Ltd.) |
| 3 | "Mater-Bi" (product of Novamont S.P.A.) |
| 4 | "Biopole" (product of ICI, Ltd.) |

An ink-receiving layer was formed by applying a coating formulation of a composition shown in the following Table 4 to the base in the same manner as in Example 1 to give a dry coat weight of 30 g/m$^2$. The base thus coated was dried at 110° C. for 5 minutes.

Respective recording media thus prepared were evaluated in ink-jet recordability and biodegradability in the same manner as in Example 1. The results are shown in Table 5.

The results were similar to those of Example 1. The recording media provided according to the present invention have good ink-jet recordability and at the same time possess biodegradability.

TABLE 4

| Component of coating formulation | Content (parts by weight) |
|---|---|
| Polyvinyl alcohol*[3] | 80 |
| Cation-modified polyvinyl alcohol*[4] | 20 |
| Water | 500 |

Note:
*[3]"PVA-217" (trade name, product of Kuraray Co., Ltd., saponification degree: 89%, polymerization degree: 1,700).
*[4]"PVA-C318-2A" (trade name, product of Kuraray Co., Ltd., saponification degree: 89%, polymerization degree: 1,800).

Example 5

A co-polyester of 3-hydroxybutyrate and 4-hydroxybutyrate [a polymer represented by the following structural formula (I)] having a thickness of 100 μm was used as a base.

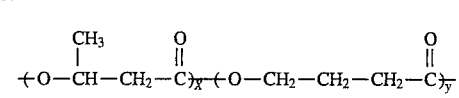

(I)

wherein x is a molar ratio of 0.30, y is a molar ratio of 0.70, and the molecular weight is about 700,000.

An ink-receiving layer was formed by applying the same coating formulation as that used in Example 1 to the base in the same manner as in Example 1 to give a dry coat weight of 30 g/m$^2$. The base thus coated was dried at 110° C. for 5 minutes.

The recording medium prepared in the above manner had a haze degree of 18%. This recording medium was evaluated in the same manner as in Examples 1 to 4. The results are shown in Table 5.

The results are similar to those of Examples 1 to 4. It was found that the recording medium can be used as an OHP film because of its sufficient transparency, and has good ink-jet recordability and at the same time possesses biodegradability.

TABLE 5

| Example | Ink absorptivity | Resolution | Resistance to curling | Bio-degradability |
|---|---|---|---|---|
| 1 | A | A | A | A |
| 2 | A | A | A | A |
| 3 | A | A | A | A |
| 4 | A | A | A | A |
| 5 | A | A | A | A |

Example 6

A sheet having a thickness of 130 μm obtained from a mixture of a polyester having the same structural formula as the polyester represented by the formula (I), in which x was a molar ratio of 0.1, y was a molar ratio of 0.9 and the molecular weight was about 1,000,000, and polyvinyl alcohol (PVA-118, product of Kuraray Co., Ltd.) added at a weight ratio of 5% by weight was used as a base. The base was coated with the same coating formulation as that used in Examples 2–4 in the same manner to give a dry coat weight of 30 g/m$^2$, thereby obtaining a transparent recording medium.

Such a recording medium had a haze degree of 15%. Its properties were evaluated in the same manner as in Example 5, and satisfactory results were obtained as to the ink-jet recordability such as ink absorptivity, resolution and resistance to curling. Besides, it exhibited a similar result to the recording medium of Example 5 as to the biodegradability.

Example 7

A recording medium was prepared in exactly the same manner as in Example 1 except that a sheet obtained from a mixture of Curdlan and polyvinyl alcohol (PVA-217, product of Kuraray Co., Ltd.) in a proportion of 10 parts by weight per 100 parts by weight of Curdlan was used as a base. The ink-jet recordability and biodegradability of the recording medium thus obtained were evaluated in the same manner as in Example 1, and exactly the same results as those in Example 1 were obtained.

Its continuous conveyability in such a printer as illustrated in FIG. 4 was further evaluated. As a result, 1000 sheets of the recording medium could be continuously fed without a single miss, and it was hence confirmed that the flexibility of the recording medium was improved.

Example 8

A recording medium was prepared in exactly the same manner as in Example 2 except that a sheet obtained from a mixture of Bionolle and polyethylene glycol having a molecular weight of about 100,000 in a proportion of 5 parts by weight per 100 parts by weight of Bionolle was used as a base. The ink-jet recordability and biodegradability of the recording medium thus obtained were evaluated in the same manner as in Example 2, and exactly the same results as those in Example 2 were obtained as to such properties.

The same conveyability test as that conducted in Example 7 was effected. As a result, 1000 sheets of the recording medium could be continuously fed without a single miss, and it was hence confirmed that the flexibility of the recording medium was improved.

As apparent from the above description and the results of the examples, the recording media according to the present invention have a good ink-jet recordability owing to the formation of a suitable ink-receiving layer, and moreover permit the most possible suppression of adverse influence on environment when they are discarded, because their bases comprise a biodegradable polymeric material. Satisfactory transparency can be achieved by suitably selecting the material of the base. Therefore, they can also be applied to recording media for OHP.

What is claimed is:

1. A recording medium comprising at least a base and an ink-receiving layer, wherein said base comprises a copolymer of 3-hydroxybutyrate and 4-hydroxybutyrate, and said ink-receiving layer comprises a water-soluble polymeric material or a hydrophilic polymeric material.

2. The recording medium according to claim 1, which has a haze degree not higher than 50%.

3. The recording medium according to claim 1, wherein the recording medium is a recording medium for ink-jet recording.

4. The recording medium according to claim 3, wherein the ink-receiving layer comprises polyvinyl pyrrolidone and cationically modified polyvinyl alcohol.

5. The recording medium according to claim 3, wherein the ink-receiving layer comprises polyvinyl alcohol and cationically modified polyvinyl alcohol.

6. The recording medium according to claim 1, wherein the recording medium is a transparent sheet for ink-jet recording.

7. The recording medium according to claim 1, wherein said copolymer contains 10 to 40% of 3-hydroxybutyrate.

8. The recording medium according to claim 1, wherein said copolymer has a molecular weight of from 100,000 to 3,000,000.

9. An ink-jet recording method comprising the steps of:

providing a recording medium comprising at least a base and an ink-receiving layer, wherein said base comprises a copolymer of 3-hydroxybutyrate and 4-hydroxybutyrate, and said ink-receiving layer comprises a water-soluble polymeric material or a hydrophilic polymeric material; and, imparting ink droplets to the recording medium.

10. The ink-jet recording method according to claim 9, wherein the recording medium has a haze degree not higher than 50%.

11. The recording method according to claim 9, wherein said copolymer contains 10 to 40% of 3-hydroxybutyrate.

12. The recording method according to claim 9, wherein said copolymer has a molecular weight of from 100,000 to 3,000,000.

13. The recording method according to claim 9, wherein the recording medium is a recording medium for ink-jet recording.

14. The recording method according to claim 9, wherein the ink-receiving layer comprises polyvinyl pyrrolidone and cationically modified polyvinyl alcohol.

15. The recording method according to claim 9, wherein the ink-receiving layer comprises polyvinyl alcohol and cationically modified polyvinyl alcohol.

16. A printed article comprising a recording medium bearing an image, the recording medium having a base and an ink-receiving layer, wherein said base comprises a copolymer of 3-hydroxybutyrate and 4-hydroxybutyrate, and said ink-receiving layer comprises a water-soluble polymeric material or a hydrophilic polymeric material, and bears an image.

17. The printed article according to claim 16, wherein the recording medium is a transparent sheet having a haze degree not higher than 50%.

18. The printed article according to claim 16, wherein said copolymer contains 10 to 40% of 3-hydroxybutyrate.

19. The printed article according to claim 16, wherein said copolymer has a molecular weight of from 100,000 to 3,000,000.

20. The printed article according to claim 16, wherein the recording medium is a recording medium for ink-jet recording.

21. The printed article according to claim 16, wherein the ink-receiving layer comprises polyvinyl pyrrolidone and cationically modified polyvinyl alcohol.

22. The printed article according to claim 16, wherein the ink-receiving layer comprises polyvinyl alcohol and cationically modified polyvinyl alcohol.

* * * * *

UNITED STATES PATENT AND TRADEMARK OFFICE

CERTIFICATE OF CORRECTION

PATENT NO. : 5,526,031

DATED : June 11, 1996

INVENTOR(S) : YUTAKA KURABAYASHI

It is certified that error appears in the above-indentified patent and that said Letters Patent is hereby corrected as shown below:

ON THE COVER PAGE:

Under "FOREIGN PATENT DOCUMENTS":

"02270588 4/1989 Japan
04179967 11/1990 Japan" should read

--2-270588 4/1989 Japan
4-179967 11/1990 Japan--.

COLUMN 3:

Line 39, "B-1,3-glucan," should read --β-1,3-glucan,--.

COLUMN 4:

Line 40, "microorganism" should read --microorganisms--.

COLUMN 6:

Line 47, "to" should be deleted; and

Line 55, "an" should read --a--.

UNITED STATES PATENT AND TRADEMARK OFFICE

CERTIFICATE OF CORRECTION

PATENT NO. : 5,526,031

DATED : June 11, 1996

INVENTOR(S) : YUTAKA KURABAYASHI

It is certified that error appears in the above-indentified patent and that said Letters Patent is hereby corrected as shown below:

COLUMN 12:

Line 19, "claim 3," should read --claim 1,--; and

Line 22, "claim 3," should read --claim 1,--.

Signed and Sealed this

Fifteenth Day of October, 1996

*Attest:*

*Attesting Officer*

BRUCE LEHMAN

*Commissioner of Patents and Trademarks*